US005293694A

United States Patent [19]

Swindle

[11] Patent Number: 5,293,694

[45] Date of Patent: Mar. 15, 1994

[54] DEVICES FOR FACILITATING THE LAYING OF TILE

[76] Inventor: James Swindle, 4626 25th Ave. North, St. Petersburg, Fla. 33713

[21] Appl. No.: 16,995

[22] Filed: Feb. 12, 1993

[51] Int. Cl.[5] ..... G01B 3/30

[52] U.S. Cl. ..... 33/527; 33/DIG. 20; 33/481

[58] Field of Search ..... 33/526, 527, 562, 563, 33/DIG. 20, 404, 408, 410, 518, 474, 481, 613, 16

[56] References Cited

U.S. PATENT DOCUMENTS

| | | | |
|---|---|---|---|
| 1,519,637 | 12/1924 | Shannon | 33/404 |
| 1,742,103 | 12/1929 | Sholtes | 33/404 X |
| 2,543,716 | 2/1951 | Carini | 33/404 X |
| 3,548,505 | 12/1970 | Candilo | 33/DIG. 20 |
| 4,930,225 | 6/1990 | Phillips | 33/562 X |

FOREIGN PATENT DOCUMENTS

| | | | |
|---|---|---|---|
| 522599 | 3/1931 | Fed. Rep. of Germany | 33/404 |

*Primary Examiner*—William A. Cuchlinski, Jr.

*Assistant Examiner*—Alvin Wirthlin

*Attorney, Agent, or Firm*—Walter J. Monacelli

[57] ABSTRACT

The devices disclosed herein are designed for the purpose of properly spacing tile from each other to provide the desired width of space between tiles to give the desired grout line. The first device has a length sufficient to span the length or width of at least three tiles and likewise has a lip extending downward from a linear edge thereof. The second device has a lip extending downward from a flat rectangular plate having a length shorter than the length of the individual tiles. Both of these lips have identical thicknesses to give the desired grouting space between individual tiles. In preferred modifications of these first and second devices a second lip extends upwardly at the opposite parallel edge from the edge having the first lip. By having the thickness of this second lip of a different thickness from that of the first lip, the second lip can be converted to a downwardly extending lip by inverting the devices and used to give a different dimension to the width of the grout line.

3 Claims, 2 Drawing Sheets

DEVICES FOR FACILITATING THE LAYING OF TILE

FIELD OF THE INVENTION

This invention relates to devices to facilitate the laying of tile. More specifically this invention relates to devices which space tile being laid from tile previously laid. Still more specifically this invention relates to devices which space tile from each other while being laid approximately simultaneously. Still more specifically the devices of this invention are designed and selected to give the desired width of grout line between adjacent tiles. Still more specifically the devices are designed to give a choice of a variety of grout line widths.

DESCRIPTION OF THE PRIOR ART

Candilo U.S. Pat. No. 3,548,505 describes a tool which is useful in marking or scribing a tile for subsequently cutting the tile for insertion in a narrow floor-space along a wall. As shown in FIGS. 1 and 3 the tool is placed flat on a preset tile with a first lip extending downward from a main flat plate portion of the tool. The back edge of the new tile is pressed backward against a second lip extending upward from the flat plate. The second upward lip is distanced from the first lip a sufficient distance so that the loose upper tile is exactly superimposed over the preset tile. Then a second loose tile is placed partially overlapping the superimposed tile and with its forward edge pressed against the wall. Then a scribe is used to mark on the first superimposed tile the amount of that tile to be cut off to leave a tile of the appropriate size to fit into the narrow floor-space. The tool shown in this patent is not designed to space one tile from an adjacent tile. In fact the tile appears to be cut to fit tightly against adjacent tile with no space between for grout. There is no design to provide a grout line or space for grout to be inserted between tile. Moreover there is no indication that the lower lip could be of a thickness suitable for any particular spacing or width of grout line. Furthermore there is no indication that the tool would be suitable for use during the setting of one tile adjacent to another.

Golkar U.S. Pat. No. 4,793,068 shows a spacer for setting tile. This is a four prong or three prong or two prong device which provides spacing between adjacent corners of four tiles, or near a wall provides spacing the adjacent corners of two tiles, or between two tiles. The spacers are positioned between the tile and the upper surface of the spacer in each case is below the level of the upper surface of the tile. To facilitate handling, these spacers have a bar extending upward for handling or removal of the spacers.

SUMMARY OF THE INVENTION

In the laying of tile it is generally desired to space each tile from adjacent tiles thereby leaving a space into which grouting may be applied. This space should be uniform between the various tiles and the space is often varied according to the size of tile being used. For this purpose applicant has designed a first device which comprises a rectangular thin flat plate having a length sufficient to span the width of at least three tiles preferably 3–5 tile, or even more if desired such as 3–10 tiles where the tiles are particularly small, and if adequately maneuverable and having at one side thereof a first lip extending downward from said plate. The thickness of this lip corresponds to the width of the space desired to be left between the tiles as they are laid adjacent to each other. The depth to which this lip extends downward is less than the thickness of the tile so that the lip will not extend to the adhesive layer on which the tile is laid. Advantageously the lip extends to between ¼ and ¾ the thickness of the tile preferably about half of the thickness of the tile. In conjunction with these first longer devices there are second shorter devices having a similar cross-section as in the first device but having a length shorter than the length of the tile, and also having any convenient width less than the width of the tile.

In the process of using these first and second devices the first or longer device is laid against a previously laid number of tile with the downward lip extending downward against one side of each of the tiles embraced by this second device. Then a number of tiles are arranged on the adhesive layer on which the tiles are to be set so that the first device provides the desired space between newly laid tile and the preset tile. Then as each individual tile is laid adjacent to a laid tile, the second or smaller device is placed on a laid tile to provide the appropriate space between it and the next newly applied tile. This is continued until an entire row of newly laid tile is applied. Then the first or longer device is removed and applied to the opposite edge of the newly laid tile. Likewise the second or shorter devices are removed and applied to apply the desired spacing between newly laid tile. This process is continued until the desired width of floor space is covered with tile and the process may be continued to the right or left of the space already covered with tile, until the entire floor space is covered with tile appropriately spaced from each other. Subsequently at the appropriate time the grouting material is applied according to standard grouting practice.

In a much preferred modification, these devices each have a second lip extending upward from another side of the same flat plate. This second lip has a thickness different from that of the first lip so as to provide a choice of the grouting space to be provided. By inverting this device the upper lip becomes a lower lip and thereby gives a choice of two lower lips of different thickness. While this second or upwardly extending lip may be on any of the three sides of the flat plate other than the one bearing the first lip extending downward therefrom, it is preferable to have this second, upwardly extending lip on the side opposite to and extending parallel to the side having the first lip. The parallel position of these two lips makes it possible to manufacture these devices by the extrusion of any extrudable material such as plastic, aluminum, etc. The presence of this second lip makes it possible to use a single device for two spacing operations. For example, by having a first lip of ⅛ inch thickness and the second lip of ⅜ inch thickness, it is possible to provide grout spacing of either ⅛ inch or ⅜ inch width. With a first lip of ¼ inch thickness and a second lip of ¾ inch width it is possible to provide a selection of either ¼ or ¾ inch grouting spacing. Likewise other combinations of any other convenient or desired dimensions can be used. The lip of the desired dimension will be used as the downwardly extending lip and the opposite lip will be out of the way and useful in lifting the device off the tiles.

With devices having only one lip extending downward it will be necessary to have a greater number of devices to give a variety of the desired grout space widths. With both the downward lip and the upward lip on the same device, the number of devices to give the same variety of space widths is one-half the number required for the same variety of selection. All that is required is to turn the device over to convert the upper lip to a lower lip.

DETAILED DESCRIPTION OF THE INVENTION

Figures 1, 2:
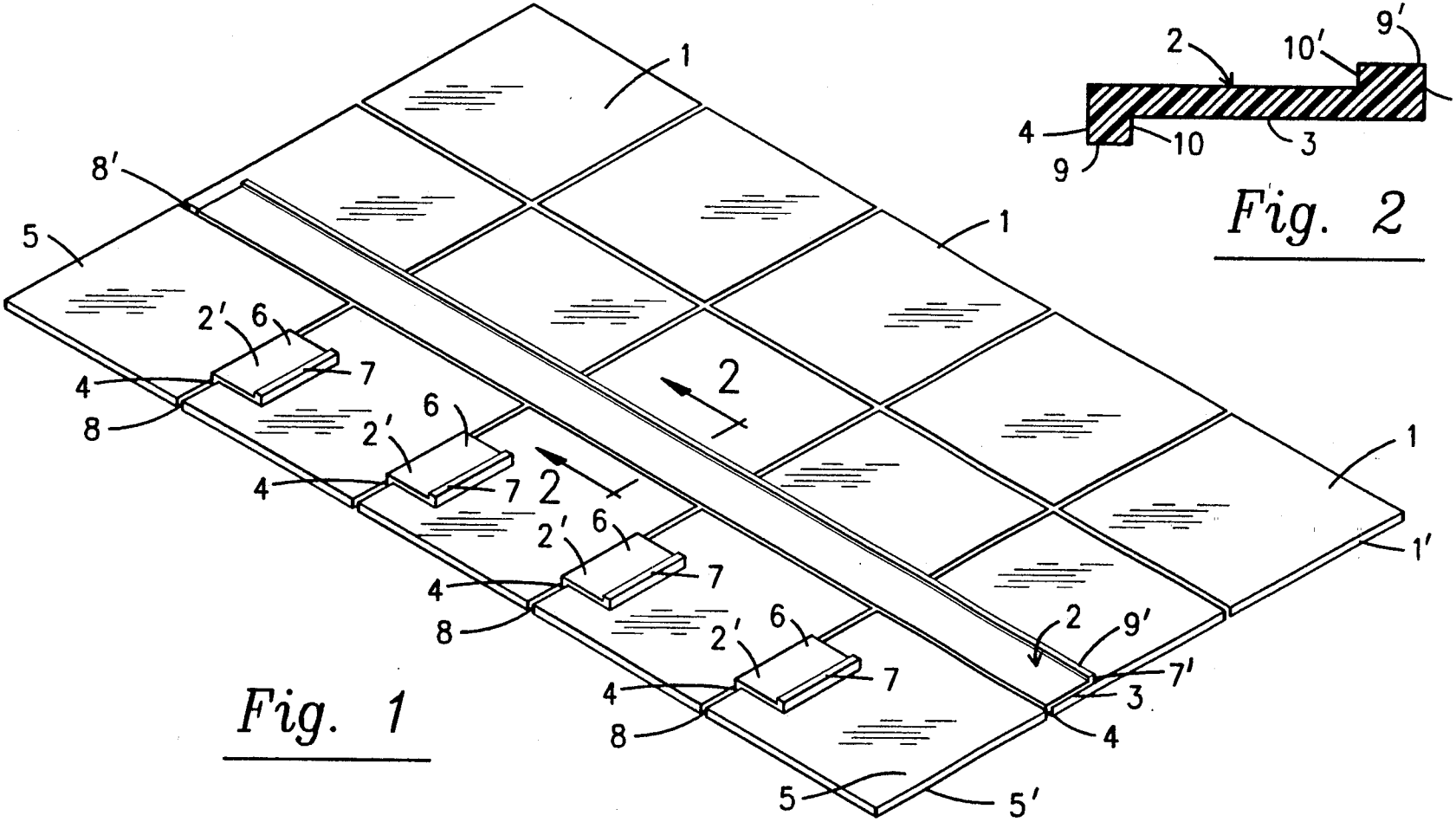
FIG. 1 is a perspective view of a preferred modification of the devices of this invention having both a lower lip and an upper lip as shown between tiles being laid.
FIG. 2 is a cross-sectional view of the modification of devices shown in FIG. 1.

Referring to FIG. 1, previously laid tiles 1 are adhered to an adhesive base (not shown). First device 2 is placed upon a series of the adjacent previously laid tiles 1 with plate 3 having a lower or first lip 4 extending downward therefrom. Lower lip 4 extends downward over the adjacent side of plate 3. Newly applied tiles 5 are spaced from previously laid laid tiles 1 by the thickness or width of lower lip 4 to provide the desired amount of space 8' for subsequent application of grouting material. As the new tiles 5 are placed in position the second devices 2' are progressively positioned on each tile with lower lip 4 extending downward over the sides of the tile to provide the grout line 8 or the spacing between adjacent tiles. Upwardly extending or second lip 7 is provided to accommodate the choice of a second spacing element by turning the device upside down with the second lip 7, in this case, giving a wider space between tiles by virtue of the greater width of second lip 7.

FIG. 2 shows a cross-sectional view of first device 2 taken at line 2—2. This cross-section is identical to the corresponding cross-section of device 1 since device 1 is preferably cut from a longer length such as device 2. In FIG. 2, first device 2 comprises plate 3 with downwardly extending lip 4. Line 9 represents the width of lower lip 4 which will determine the width of the ultimate grouting space 8. Line 10 is the depth of the downwardly extending lip 4 which determines how far the lip will extend below the upper surface of the tiles on which the device is rested. This depth is less than the thickness of the tile on which the device is rested so that this lip will not reach the adhesive base on which the tiles are to be adhered. At the opposite edge of the first device from the edge having the downwardly extending lip 4, lip 7 extends from plate 3. The length of line 9' is the width of the lip 7 and determines the grout spacing 8 between adjacent tile when this second device is inverted so that this upper lip becomes a lower lip. As previously stated, greater lengths of the first device can be cut into shorter lengths to provide the second device. The various elements of the first device are as defined above for the second device.

Figure 3:
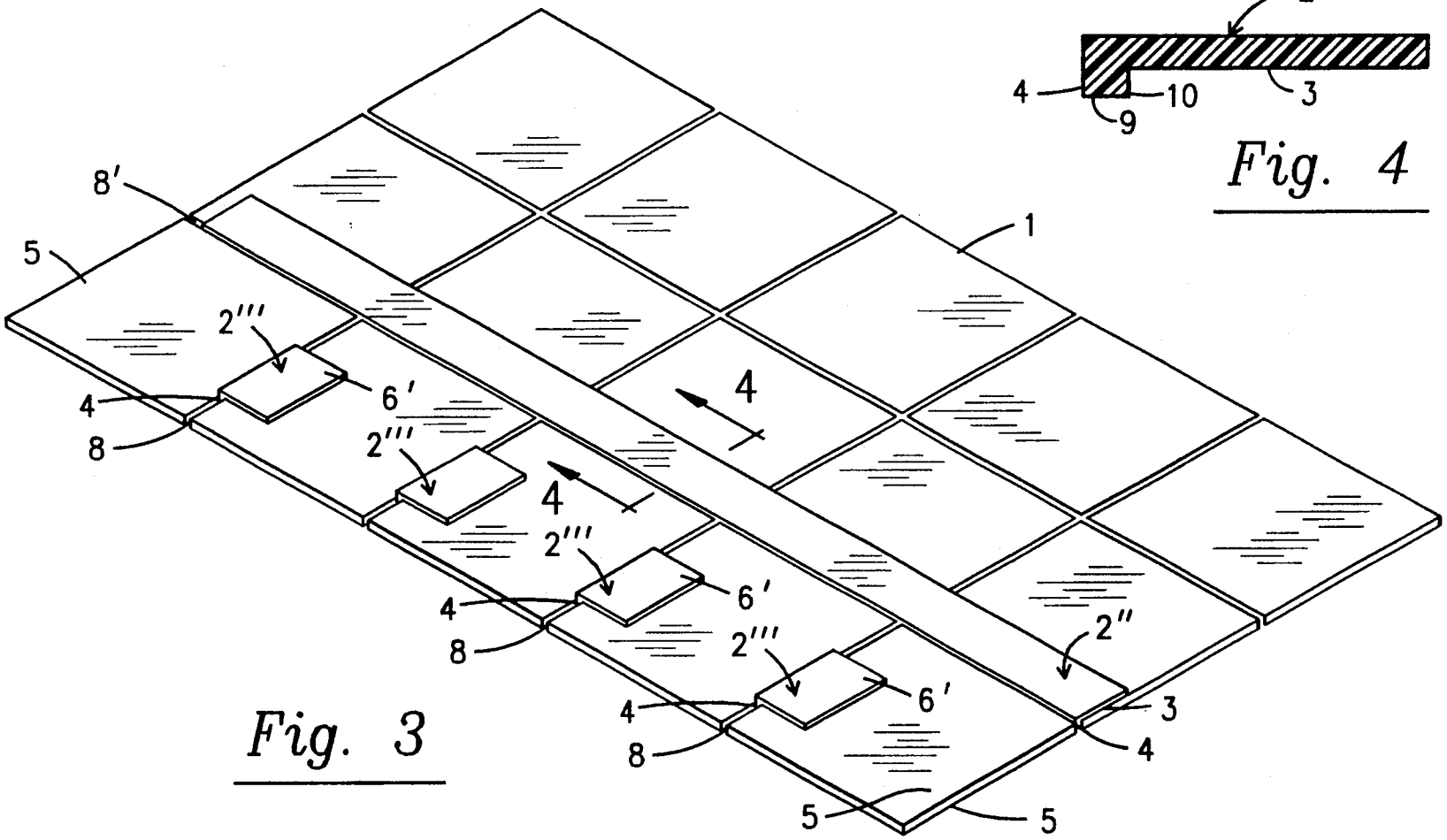
FIG. 3 is a perspective view of a modification of devices of this invention having only a lower lip shown between tiles being laid.

FIG. 3 shows a third device and a fourth device 6' having similar elements as in FIG. 1 except that the upwardly extending lip 7 of FIG. 1 is omitted. The other elements may be identical to those given in the description of FIG. 1 and corresponding reference numerals are given as in FIG. 1.

Figure 4:
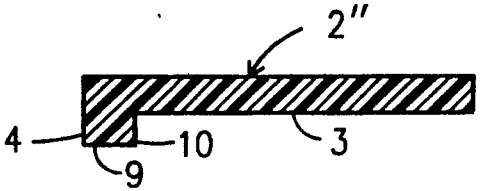
FIG. 4 is a cross-sectional view of the modification of devices of this invention shown in FIG. 3.

FIG. 4 is a cross-sectional view of the third device 2" taken at line 4—4 of FIG. 3. Likewise the cross-sectional view of the shorter or fourth device 6' is identical to that of FIG. 4 since the longer fourth device 2 may be cut into shorter lengths to give a number of the fourth devices 6'.

The devices of this invention may be made of any appropriate material, for example, a metal, such as aluminum, wood, or preferably a plastic such as polystyrene, polyethylene, polypropylene, etc.

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The invention claimed is:

1. A combination of at least five flat rectangular tiles, each tile having similar rectangular dimensions, and having similar thickness dimensions, a first spacing device and a second spacing device for determining in the laying of said rectangular tile the spacing between adjacent tiles;

(a) said first spacing device comprising a four sided rectangular flat plate section having the length of each of two parallel sides thereof of a dimension greater than three times the greater side length of the rectangular individual tile and the remaining two sides of said rectangular flat plate section each having a dimension of a length less than each of the rectangular dimensions of the individual tiles, and having a lip extending downwardly from a first side of said flat plate section, said lip having a thickness corresponding in dimension to the width of the spacing desired between adjacent tile and a depth between $\frac{1}{4}$ and $\frac{3}{4}$ the dimension of the thickness of the tile;

(b) said second spacing device comprising a four-sided rectangular flat plate section having a length shorter than each of the sides of said individual tiles and having a lip extending downwardly from a first side of said flat plate section, the thickness and depth of said downwardly extending lip corresponding to the width and depth of the lip extending downwardly from said first spacing device, whereby the space between adjacent tiles is approximately the same as determined by said two downwardly extending lips, and (c) in which said second spacing device has a lip extending upwardly from a second side of said rectangular flat plate section, the thickness of said upwardly extending lip having a thickness different in dimension from the thickness of said lip extending downwardly from said second spacing device and corresponds to another width of space desired between adjacent tiles, and said first spacing device having a lip extending upwardly from the side of said rectangular flat plate section opposite to and parallel to the side of said flat plate section from which the downwardly extending lip extends, the thickness of said upwardly extending lip of said second spacing device corresponding substantially to the thickness of the upwardly extending lip of said first spacing device.

2. The combination of claim 1 in which the upwardly extending lip of said second spacing device extends from the side of said rectangular flat plat plate section of said second device opposite and parallel to that side of said flat plate from which the downwardly extending lip extends.

3. A process of providing desired uniformity and width of spacing between adjacent tiles in the laying of rectangular tile having four sides on an adhesive layer comprising the steps of:

(a) positioning against the exposed edge of a previously laid row of said tile a first spacing device having a length equal to the exposed edges of at least three said tile, having as a main body portion a rectangular flat plate section having a length equal to at least three times the length of said tile being laid and a width smaller in dimension than each rectangular side of the tile, said device having a lip extending downwardly from a linear edge of said flat plate section, said lip having a thickness corresponding in dimension to the width of the spacing desired between adjacent tile and a depth between $\frac{1}{4}$ and $\frac{3}{4}$ the dimension of the thickness of the tile;

(b) resting the main body portion of said first spacing device on top of said previously laid tile with the lip of said first spacing device embracing the exposed edges of said tile;

(c) successively laying individual said tile on said adhesive layer and against said lip of said first device, and as each individual said tile is placed adjacent to a said laid tile a second spacing device is positioned on the said laid tile with a lip extending down between the said laid tile and a newly positioned adjacent said tile so as to provide the desired spacing between these two said tile, this second device comprising a four-sided rectangular flat plate section having a lip extending downwardly from a first side of said flat plate section of said second plating device, the thickness and depth of this lip corresponding to the width and depth of the lip extending downwardly from said first device, whereby the spacing between various adjacent tiles are uniform;

(d) this above procedure being repeated a number of times until said entire adhesive layer is completely covered with said tile.

* * * * *